US006853280B2

(12) United States Patent
Sugawara et al.

(10) Patent No.: US 6,853,280 B2
(45) Date of Patent: Feb. 8, 2005

(54) METHOD OF MAGNETIZING MAGNETIC SHEET AND MAGNETIZATION APPARATUS

(75) Inventors: Toshiaki Sugawara, Miyagi (JP); Shinichi Matsumura, Miyagi (JP); Kazuto Kawamata, Miyagi (JP); Eiji Ohta, Miyagi (JP)

(73) Assignee: Sony Corporation, Tokyo (JP)

( * ) Notice: Subject to any disclaimer, the term of this patent is extended or adjusted under 35 U.S.C. 154(b) by 118 days.

(21) Appl. No.: 10/334,014

(22) Filed: Dec. 30, 2002

(65) Prior Publication Data

US 2003/0218525 A1 Nov. 27, 2003

(30) Foreign Application Priority Data

Jan. 31, 2002 (JP) ..... 2002-022640
Sep. 26, 2002 (JP) ..... 2002-281412

(51) Int. Cl.[7] ..... H01F 13/00
(52) U.S. Cl. ..... 335/284
(58) Field of Search ..... 335/284–306

(56) References Cited

U.S. PATENT DOCUMENTS 4,684,930 A * 8/1987 Minasy et al. ..... 340/551
5,428,332 A * 6/1995 Srail et al. ..... 335/302
5,942,961 A * 8/1999 Srail et al. ..... 335/284
6,369,679 B1 * 4/2002 Cloutier et al. ..... 335/284

FOREIGN PATENT DOCUMENTS

| | | |
|---|---|---|
| JP | 58-178508 | 10/1983 |
| JP | 61-007609 | 1/1986 |
| JP | 10-024534 | 1/1998 |
| JP | 2001-068337 | 3/2001 |
| JP | 2001-076920 | 3/2001 |
| JP | 2001-228542 | 8/2001 |
| JP | 2001-230118 | 8/2001 |
| JP | 2001-231833 | 8/2001 |
| JP | 2001-256774 | 9/2001 |
| JP | 2001-297911 | 10/2001 |

* cited by examiner

*Primary Examiner*—Ramon M. Barrera
(74) *Attorney, Agent, or Firm*—Robert J. Depke; Holland & Knight LLP

(57) ABSTRACT

A method of magnetizing a magnetic sheet, said method able to magnetize a roll sheet conveniently at a high speed and stably including the steps of bringing a cylindrical permanent magnet having N-poles and S-poles multipolar-magnetized alternately along its circumference into contact with one surface of a long magnetic sticking sheet having an axis of easy magnetization oriented in a sheet longitudinal direction so that the sheet longitudinal direction is orthogonal to a shaft of the permanent magnet and multipolar-magnetizing the magnetic sticking sheet along the axis of easy magnetization by rotating the cylindrical permanent magnet due to the magnetic sticking sheet being rolled up, wherein the angle of contact of the magnetic sticking sheet fed to the cylindrical permanent magnet is made 45° or less, and a magnetization apparatus used for the method.

5 Claims, 6 Drawing Sheets

METHOD OF MAGNETIZING MAGNETIC SHEET AND MAGNETIZATION APPARATUS

This application claims priority to Japanese Patent Application Number JP2002-022640 filed Jan. 31, 2002 and Japanese Patent Application Number JP2002-281412 filed Sep. 26, 2002, both of which are incorporated herein by reference.

BACKGROUND OF THE INVENTION

1. Field of the Invention

The present invention relates to a method of multipolar-magnetization of a rollable long magnetic sticking sheet so as to enable it to be stuck to a ferrous metal surface or other soft magnetic material by magnetic force and to a simple magnetization apparatus for the same.

2. Description of the Related Art

As a conventional magnetic sticking sheet, one comprised of a flexible hard magnetic sheet formed by extrusion or calendaring and then multipolar-magnetized can be mentioned. In the extrusion or calendaring, a mixture of particles of a hard magnetic material such as barium ferrite or strontium ferrite and a binder such as rubber or plastic is compressed to form a flexible hard magnetic sheet having a thickness of for example 0.05 to 0.5 mm (see Japanese Unexamined Patent Publication (Kokai) No. 10-24534). As another conventional magnetic sticking sheet, one comprised of a substrate coated with a magnetic coating, dried, then multipolar-magnetized can be mentioned (see Japanese Unexamined Patent Publication (Kokai) No. 58-178508, Japanese Unexamined Patent Publication (Kokai) No. 2001-76920, Japanese Patent Application No. 2001-231833 (Japanese Patent No. 3297807), and Japanese Patent Application No. 2001-228542 (Japanese Patent No. 3309854)).

On the other hand, as a method of multipolar-magnetization of a magnetic sticking sheet, a method using a capacitor type power supply for magnetization can be mentioned. In this method, a plate-shaped multipolar magnetization yoke is placed closely against the sheet to be magnetized and a large current is supplied to the yoke using a capacitor type power supply for magnetization to create N-poles and S-poles periodically on one side or both sides of the sheet (see Japanese Unexamined Patent Publication (Kokai) No. 2001-76920 and Japanese Unexamined Patent Publication (Kokai) No. 61-7609).

As another method of magnetization, a method of arranging plate-type permanent magnets in a line to create a combined permanent magnet and moving it relative to the sheet to be magnetized is also disclosed (see Japanese Patent Application No. 2001-231833 (Japanese Patent No. 3297807), Japanese Patent Application No. 2001-228542 (Japanese Patent No. 3309854), Japanese Unexamined Patent Publication (Kokai) No. 2001-68337, Japanese Unexamined Patent Publication (Kokai) No. 2001-230118, Japanese Unexamined Patent Publication (Kokai) No. 2001-297911, and Japanese Patent Application No. 2001-256774 (Japanese Patent No. 3309855). In the combined permanent magnets described in Japanese Patent No. 3297807, No. 3309854, and No. 3309855, the plate type permanent magnets are arranged so that different poles face each other. As opposed to this, in the combined permanent magnets described in Japanese Unexamined Patent Publication (Kokai) Nos. 2001-68337, 2001-230118, and 2001-297911, the plate type permanent magnets are arranged so that the same poles face each other.

As described in Japanese Patent No. 3297807, No. 3309854, and No. 3309855, when forming a magnetic layer by coating a magnetic coating on a substrate and multipolar-magnetizing it by a combined permanent magnet, it is also possible to produce a long magnetic sticking sheet reel to reel, that is, in-line.

As described in the Japanese Unexamined Patent Publications (Kokai) No. 2001-76920 and No. 61-7609, when multipolar-magnetizing by a capacitor type magnetization apparatus, the larger the area of the magnetic sticking sheet, the larger the scale of the magnetization system required and the more expensive the equipment cost. Further, since a large current is supplied during magnetization, there is the danger of electric leakage, shock, etc.

Further, charging is necessary before discharge, so the magnetization is conducted intermittently. In other words, continuous magnetization is not possible. Therefore, particularly when producing a long sheet roll, the productivity falls. For these reasons, the running cost of the capacitor type magnetization apparatus becomes higher.

As a method of increasing the magnetic sticking force of a magnetic sticking sheet, there is the method of making the magnetization pitch narrower. However, in the case of a capacitor type magnetization apparatus, a large current is supplied instantaneously, so discharge ends up occurring between electrodes if the magnetization pitch is made narrower to for example 2 mm or less. Therefore, there is a limit to narrowing the magnetization pitch and therefore a limit to the magnetization strength.

According to the multipolar-magnetization method using a permanent magnet, the above problems found in the capacitor type magnetization apparatus are solved. However, as shown in FIG. 1, in the cylindrical combined permanent magnet described in Japanese Unexamined Patent Publications (Kokai) No. 2001-68337, No. 2001-230118, and No. 2001-297911, the plate type permanent magnets are stacked so that the same poles face each other. Further, as shown in FIG. 2, in the cylindrical combined permanent magnet described in Japanese Unexamined Patent Publication (Kokai) No. 2001-230118, thin plate type permanent magnets are arranged so that the same poles face each other.

Due to this, a repulsive force acts between the stacked plate type permanent magnets. Therefore, unless an external force of a magnitude canceling out the repulsive force is continuously supplied, the configuration as a combined permanent magnet cannot be maintained. Further, in the combined permanent magnets described in Japanese Unexamined Patent Publication (Kokai) No. 2001-68337, No. 2001-230118, and No. 2001-297911, if the magnetization pitch is made narrower for the purpose of increasing the magnetic sticking force of the magnetic sticking sheet to be magnetized, the plate type permanent magnets inevitably become thinner. Due to this, the distance between magnetic poles becomes shorter and the leakage magnetic flux density decreases, so the magnetization force is weakened.

When rotating a combined permanent magnet having N-poles and S-poles arranged along a shaft of a cylinder as shown in FIG. 1 on a sheet, the sheet is multipolar-magnetized so that N-poles and S-poles are arranged alternately in the axial direction of the cylinder. On the other hand, when multipolar-magnetizing a long sheet by using a cylindrical combined permanent magnet, unless the axial direction of the combined permanent magnet is orthogonal to the sheet longitudinal direction, the sheet cannot be processed continuously.

When rotating a combined permanent magnet in the state where the axial direction of the cylindrical combined permanent magnet is orthogonal to the sheet longitudinal direction and the combined permanent magnet contacts the sheet to be magnetized, the sheet is magnetized proceeding along the longitudinal direction. However, according to the configuration of the combined permanent magnet shown in FIG. 1, the N-poles and S-poles are arranged along the shaft of the cylinder, so this is not suitable for continuous multipolar-magnetization of a long sheet having an axis of easy magnetization oriented in the sheet longitudinal direction.

Japanese Patent No. 3309854 and No. 3309855 disclose methods of magnetization wherein a square columnar combined permanent magnet is moved relative to the sheet to be magnetized are disclosed, but have no specific description about a cylindrical combined permanent magnet.

Japanese Patent No. 3297807 discloses a cylindrical combined permanent magnet composed of permanent magnets arranged so that the different pole surfaces face each other as shown in FIG. 3. According to this combined permanent magnet, the N-poles and S-poles are arranged alternately on the circumference, so by rotating the combined magnet on a long sheet, it is possible to continuously multipolar-magnetize a long sheet having an axis of easy magnetization oriented in the sheet longitudinal direction. Further, since the permanent magnets composing the combined permanent magnet are arranged cylindrically so that the different pole surfaces face each other, no repulsive force acts between permanent magnets.

As described above, according to the cylindrical combined permanent magnet for magnetization described in Japanese Patent No. 3297807, it is possible to magnetize a long sheet conveniently at a high speed. However, in the method of magnetization described in Japanese Patent No. 3297807, when the angle of contact of the sheet fed to the cylindrical combined permanent magnet is not suitable, problems specific to the magnetic sticking sheet not found in usual roll paper arise.

When printing or coating a coating material on roll paper, wrinkling of the paper being rolled, slack, uneven rolled end surfaces, etc. are prevented by adjusting the angle of contact and tension of the paper. However, when magnetizing a roll type magnetic sticking sheet by a cylindrical magnet, since the magnetic sticking force acts between the sheet being magnetized and the magnet, if the angle of contact is larger than necessary, the sheet sticks to the magnet more than the angle of contact.

Due to this, the sheet traveling over the cylindrical magnet flaps around and obstructs the feed of the sheet. If the sheet does not travel smoothly, the entire surface of the sheet may not be magnetized uniformly or slack may occur when rolling up the magnetized sheet. Further, even if adjusting the tension of the sheet fed to the magnet, since the effect of the magnetic sticking force acting between the sheet and the cylindrical magnet is large, it is difficult to improve the running condition of the sheet by adjusting the tension.

In recent years, demand for printers able to print on large size paper such as A0 size paper has increased. At present, roll paper is used for all of commercially available printers for large size paper. Therefore, when desiring to produce a large size printed object from a magnetic sticking sheet, it is necessary to feed the sheet to the printer from a roll.

SUMMARY OF THE INVENTION

An object of the present invention is to provide a method of magnetization able to magnetize a roll sheet conveniently, at a high speed, and stably.

Another object of the present invention is to provide a magnetization apparatus able to magnetize a roll sheet conveniently, at a high speed, and stably.

According to a first aspect of the present invention, there is provided a method of magnetization comprising the steps of bringing a cylindrical permanent magnet having N-poles and S-poles multipolar-magnetized alternately along its circumference into contact with one surface of a magnetic sticking sheet having a long shape and an axis of easy magnetization oriented in a sheet longitudinal direction in the state with the sheet longitudinal direction orthogonal to the shaft of the cylindrical permanent magnet and rolling the magnetic sticking sheet from one end in the sheet longitudinal direction to make the cylindrical permanent magnet contacting the magnetic sticking sheet rotate and multipolar-magnetize the magnetic sticking sheet along the axis of easy magnetization, wherein an angle of contact made by a normal line to a surface of the magnetic sticking sheet at one end of the part of the cylindrical permanent magnet contacting the magnetic sticking sheet in the sheet longitudinal direction and a normal line to a surface of the magnetic sticking sheet at the other end is made 45° or less.

Due to this, it becomes possible to prevent the magnetic sticking sheet from sticking excessively to the cylindrical permanent magnet during magnetization, flapping of the sheet, and uneven magnetization.

Preferably, as the cylindrical permanent magnet, a cylindrical combined permanent magnet comprised of a plurality of thin plate type magnets having one pole at the circumference side and the other pole at the shaft side arranged so that different pole surfaces face each other is used. Due to this, no repulsive force acts between the thin plate type permanent magnets comprising the cylindrical permanent magnet and a stable combined permanent magnet is obtained.

According to a second aspect of the present invention, there is provided a magnetization apparatus comprising a cylindrical permanent magnet having N-poles and S-poles multipolar-magnetized alternately along its circumference and able to rotate around its shaft, a shaft holding means for fixing the position of the shaft, a sheet feeding means for feeding a long magnetic sticking sheet having an axis of easy magnetization oriented in a sheet longitudinal direction to the cylindrical permanent magnet so that the sheet longitudinal direction is orthogonal to the shaft and the magnetic sticking sheet and part of the circumference contact each other, a rolling means for rolling up the magnetic sticking sheet multipolar-magnetized by passing over the cylindrical permanent magnet, and a contact angle controlling means for adjusting an angle of contact formed by a normal line to a surface of the magnetic sticking sheet at one end in the sheet longitudinal direction at a part where the cylindrical permanent magnet and the magnetic sticking sheet contact each other and a normal line to a surface of the magnetic sticking sheet at the other end to 45° or less.

Due to this, it becomes possible to magnetize a long magnetic sticking sheet on a cylindrical permanent magnet smoothly. According to the magnetization apparatus of the present invention, the magnetic sticking sheet does not stick excessively to the cylindrical permanent magnet and flapping of the sheet during magnetization is prevented. Further, since the magnetization apparatus of the present invention uses a permanent magnet for magnetization, the energy consumption is reduced dramatically compared with the case using a capacitor type magnetization apparatus. Further, it is possible to magnetize a long sheet continuously.

BRIEF DESCRIPTION OF THE DRAWINGS

These and other objects and features of the present invention will become clearer from the following description of a preferred embodiment given with reference to the accompanying drawings, in which.

DESCRIPTION OF THE PREFERRED EMBODIMENTS

Below, a preferred embodiment of the present invention will be described in detail.

A cylindrical permanent magnet used for magnetization of a magnetic sticking sheet in the present invention is formed by casting, sintering, etc. a ferromagnetic material. It is possible to use a known ferromagnetic material having a large maximum energy product, for example, barium ferrite ($BaO \cdot 6Fe_2O_3$) strontium ferrite ($SrO \cdot 6Fe_2O_3$), samarium-cobalt (Sm—Co), samarium-iron-nitrogen (Sm—Fe—N), or neodymium-iron-boron (Nd—Fe—B). Among them, Nd—Fe—B—, Sm—Co—, and Sm—Fe—N— based rare earth magnetic materials are particularly preferable.

The residual magnetic flux density of the cylindrical permanent magnet is not particularly limited so long as the magnetic sticking sheet can be magnetized. However, it is preferable for the cylindrical permanent magnet to have a maximum surface magnetic flux density generating an external magnetic field of two times or more the coercive force of the magnetic sticking sheet to be magnetized at the surface of the magnet where the N-poles and S-poles adjoin each other.

Figure 1:
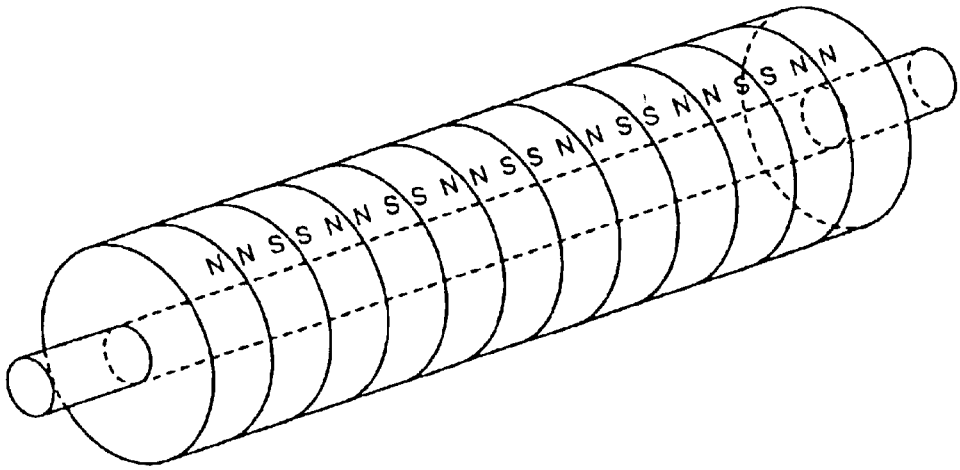
FIG. 1 PRIOR ART
FIG. 1 is a perspective view of an example of a conventional magnetization apparatus.
Figure 2:
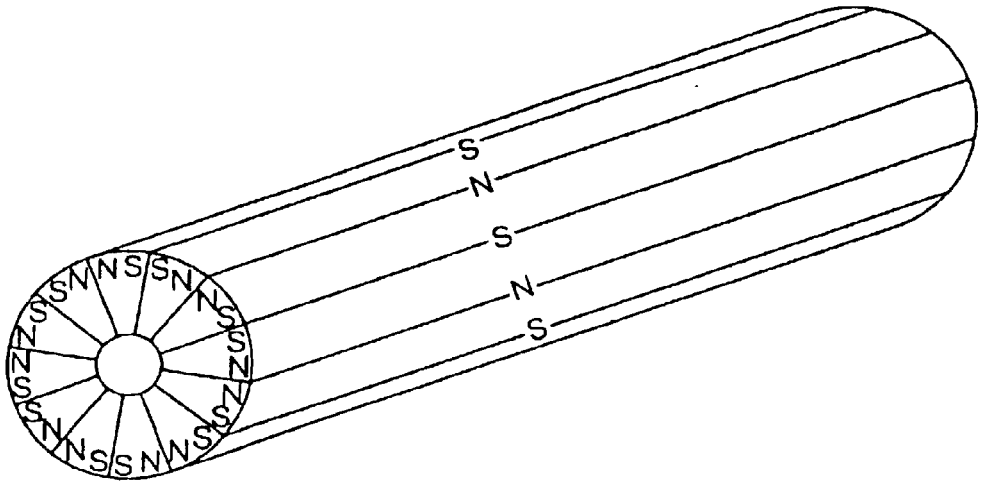
PRIOR ART FIG. 2
FIG. 2 is a perspective view of another example of a conventional magnetization apparatus.
Figure 3:
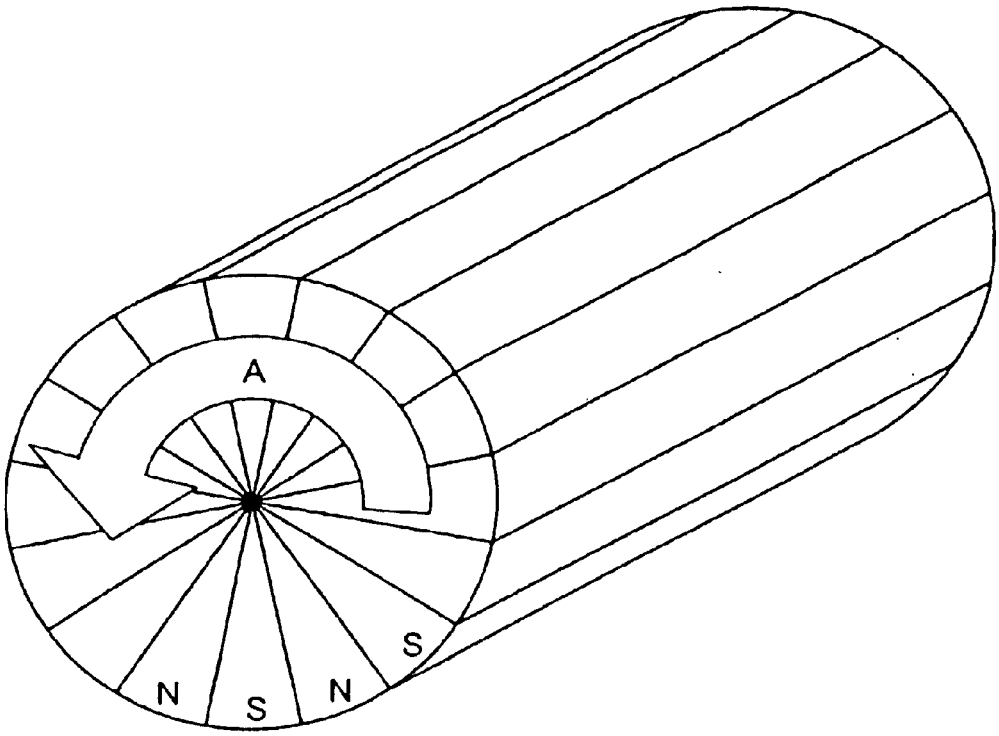
FIG. 3 is a perspective view of another example of a conventional magnetization apparatus.
Figure 4:
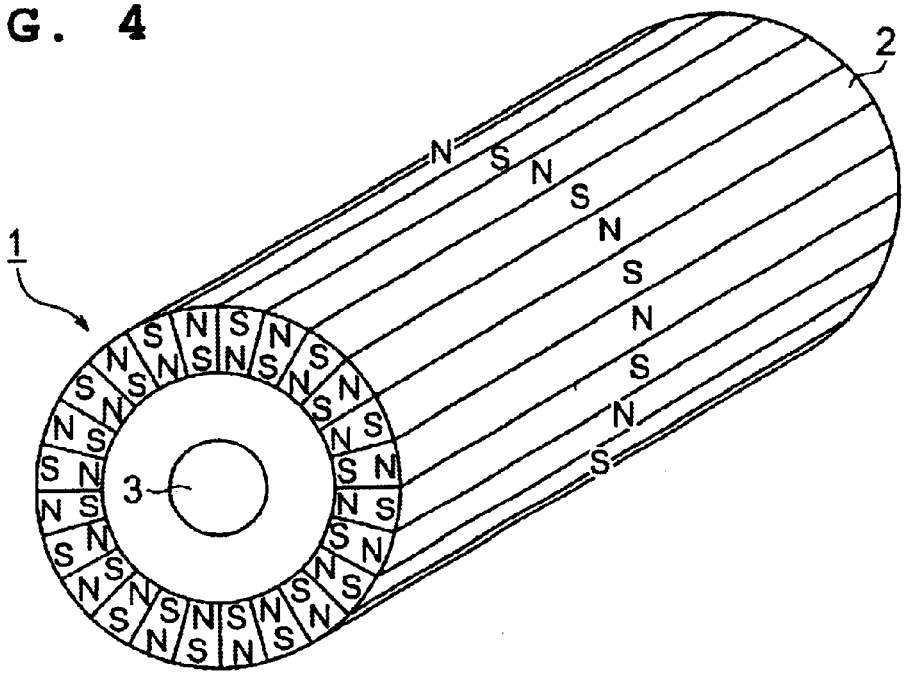
FIG. 4 is a perspective view of a cylindrical combined permanent magnet used for a method of magnetization of the present invention.

The poles of the cylindrical permanent magnet are arranged as shown in FIG. 4 with different poles alternating on the circumference. Strong magnetic lines of force leak out from the surface where different poles of N-poles and S-poles face each other so as to form a periodical parabolic distribution of magnetic lines of force near the surface. Therefore, when placing a magnetic sticking sheet in the distribution of the periodic magnetic lines of force, it becomes possible to multipolar-magnetize it.

The form of magnetization of the cylindrical permanent magnet is not particularly limited. It may be in the radial direction or the pole anisotropic direction. FIG. 4 shows permanent magnets magnetized in the radial direction. In the figure, S and N show poles of the cylindrical permanent magnet arranged alternately. As shown in FIG. 4, in the combined permanent magnet 1 magnetized in the radial direction, a plurality of thin plate type permanent magnets 2 are arranged so that different pole surfaces face each other.

In each thin plate type permanent magnet 2, one pole is located at the surface side of the combined permanent magnet 1 while the other pole is located at the side near the shaft 3 of the combined permanent magnet 1. In the combined permanent magnet 1 of this configuration, even if the thin plate type permanent magnet 2 is made thinner for the purpose of decreasing the magnetization pitch, the distance between poles is not shortened. Therefore, when making the magnetization pitch shorter, it is hard to lower the leakage magnetic flux density.

Figure 5A:
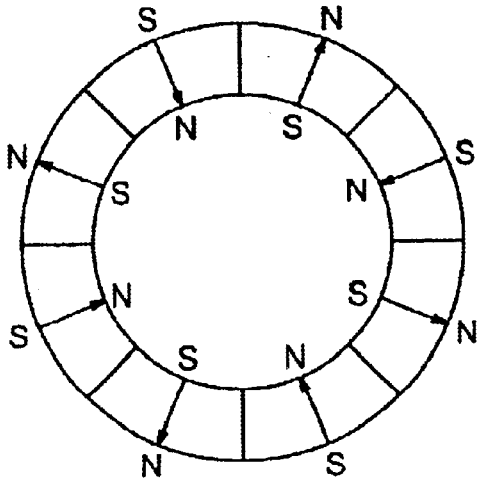
FIGS. 5A and 5B are views of the directions of magnetization of permanent magnets used for a method of magnetization of the present invention.
Figure 5B:
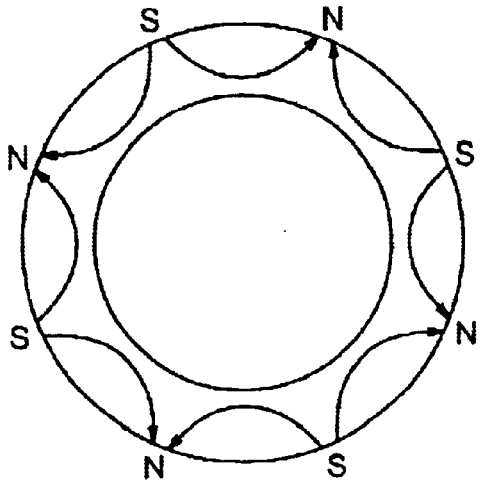

FIG. 5A is a schematic cross-sectional view of permanent magnets magnetized in the radial direction, while FIG. 5B is a schematic cross-sectional view of permanent magnets magnetized in the pole anisotropic direction. In both cases, different poles are arranged alternately on the circumference of the magnet surface and can be used for multipolar-magnetization of a magnetic sticking sheet.

While the magnetization pitch can be suitably determined by the residual magnetic flux density of the magnets themselves, the coercive force or thickness of the magnetic sticking sheet to be magnetized, etc., for making the magnetic sticking force of the magnetized magnetic sticking sheet a practical range, it is preferable to make it a range of 0.5 mm to 5 mm.

Figure 6:
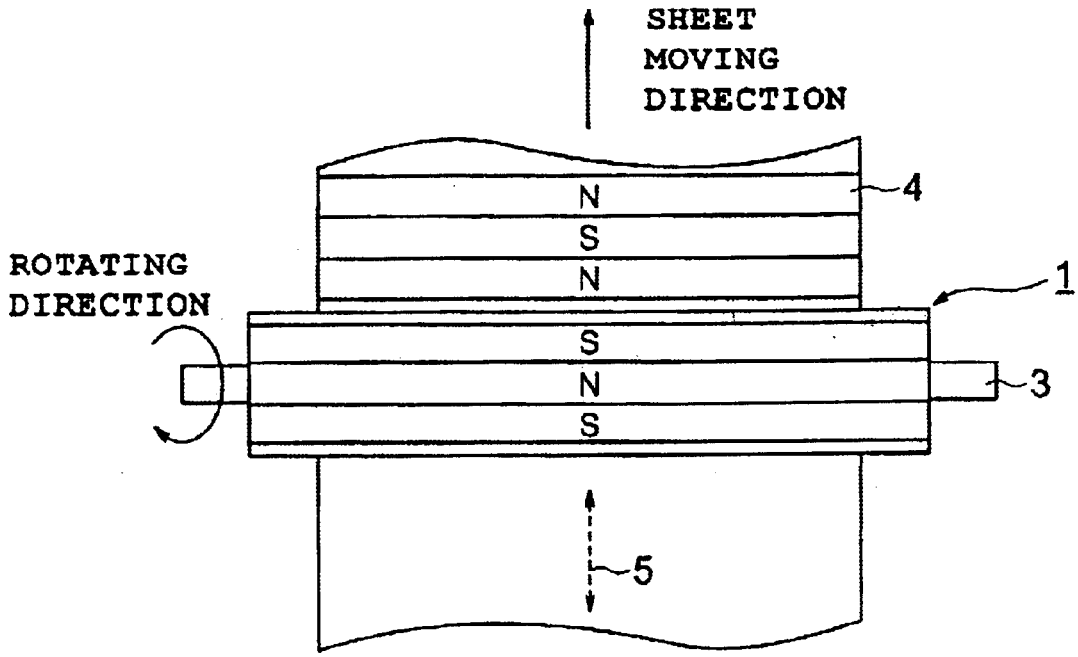
FIG. 6 is a view of magnetization of a magnetic sticking sheet using a cylindrical permanent magnet according to a method of magnetization of the present invention.

As shown in FIG. 6, in multipolar-magnetization of a roll type magnetic sticking sheet, by feeding the magnetic sticking sheet 4 along the direction of its axis of easy magnetization 5 while rotating the cylindrical permanent magnet 1 having N-poles and S-poles magnetized alternately in the circumferential direction, it is possible to obtain a magnetized magnetic sticking sheet.

Figure 7:
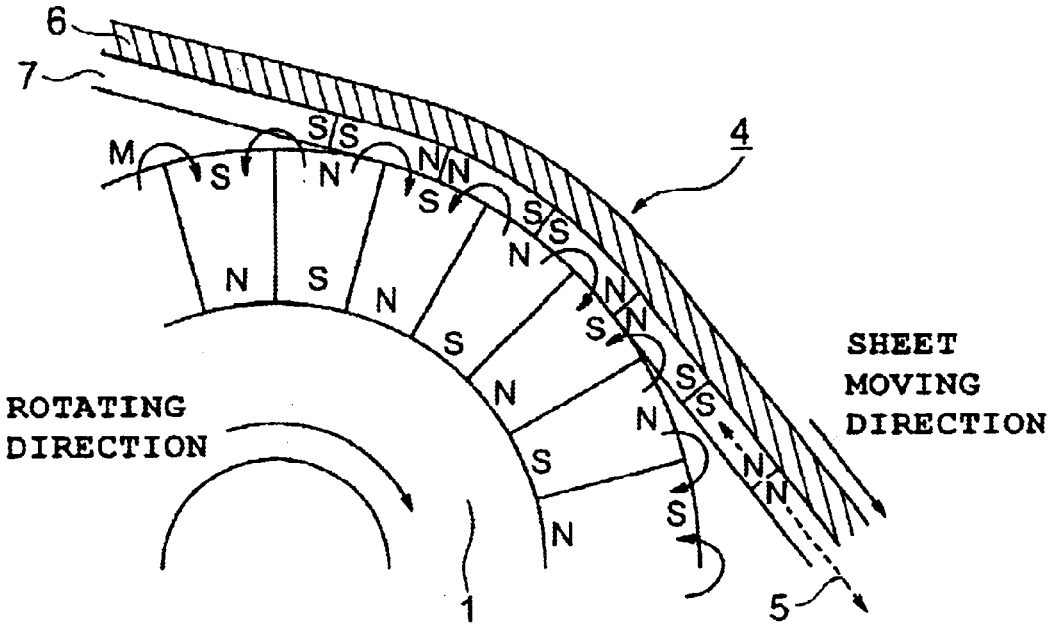
FIG. 7 is a schematic view of multipolar-magnetization in a parallel direction to a magnetic layer according to a method of magnetization of the present invention.

FIG. 7 is a schematic view of the state of in-plane multipolar-magnetization of the cylindrical permanent magnet. As shown in FIG. 7, a magnetic sticking sheet 4 comprised of a non-magnetic base 6 formed with a magnetic layer 7 is fed so that its magnetic layer 7 side contact the cylindrical permanent magnet 1. Due to this, it is alternately magnetized in N poles and S poles along the traveling direction of the sheet in the direction of axis of easy magnetization 5 in the in-plane direction of the magnetic layer 7. The arrows M at the surface of the cylindrical permanent magnet 1 show the magnetic lines of force.

To make the combined permanent magnet 1, it is necessary to fix the array of the thin plate type permanent magnets 2. The material of the fixing shaft 3 can be a metal, plastic, or any other material able to fix the magnets stably. The thin plate type permanent magnets 2 can be fixed to the fixing shaft 3 by the use of an adhesive or any other method able to fix them stably. When forming the combined permanent magnet 1 by arranging the thin plate type permanent magnets 2 around the fixing shaft 3, to obtain a stronger surface magnetic flux density, it is also possible to insert a back yoke of a soft magnetic material such as iron at the fixing shaft side.

The closer the magnetic sticking sheet and the cylindrical permanent magnet in distance, the more effective the magnetization. When bring them into contact, the maximum effect can be obtained. Further, for preventing contact of the cylindrical permanent magnet with the magnetized sheet from scratching the surface of the magnetic sticking sheet, it is possible to polish and smooth the surface of the permanent magnet contacting the magnetized sheet or to coat it with a protective coating material.

Figure 8:
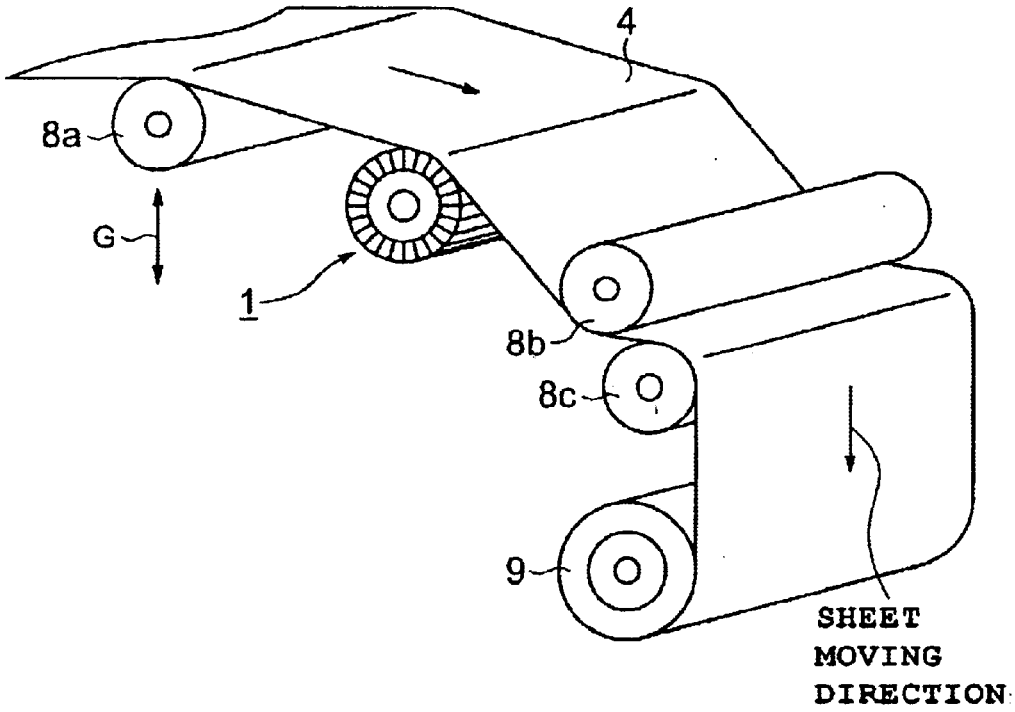
FIG. 8 is a perspective view of a magnetization apparatus of the present invention.

An example of a magnetization apparatus incorporating a cylindrical permanent magnet as explained above is shown in FIG. 8. In production of a long magnetic sticking sheet, a series of steps including feeding of a non-magnetic base, coating and drying of a magnetic coating material, magnetization, and rolling can be performed in-line. FIG. 8 shows the hardware configuration of the parts from magnetization to rolling. According to the configuration shown in FIG. 8, it is possible to magnetize the magnetic sticking sheet formed with a magnetic layer by coating and drying a magnetic coating material in-line at a high efficiency.

In the apparatus of FIG. 8, the cylindrical permanent magnet 1 and guide rolls 8*a* to 8*c* are supported so as to be able to rotate. By making the sheet rolling means, that is, the rolling reel 9, rotate, the sheet 4 is fed continuously from the apparatus for coating and drying the magnetic coating material. The fed sheet 4 is magnetized continuously due to contact with the cylindrical permanent magnet 1.

The rolling reel 9 is provided with an electric motor, but the cylindrical permanent magnet 1 is not provided with a driving means (motor). Since the magnetic sticking sheet 4 is magnetized while stuck to the cylindrical permanent magnet 1, when the magnetic sheet 4 is moved, the cylindrical permanent magnet 1 rotates along with movement of the sheet 4. Further, since the magnetic sheet 4 is magnetically attached, there is no need to place a pressure roller facing the cylindrical permanent magnet 1.

The cylindrical permanent magnet 1 is placed between the two guide rolls 8*a*, 8*b* and supported so as to be adjustable in angle of contact. For example, by moving the shaft of the guide roll 8*a* in the direction shown by the arrow G, the angle of contact can be adjusted. Note that the means for controlling the angle of contact is not limited to this example.

Figure 9:
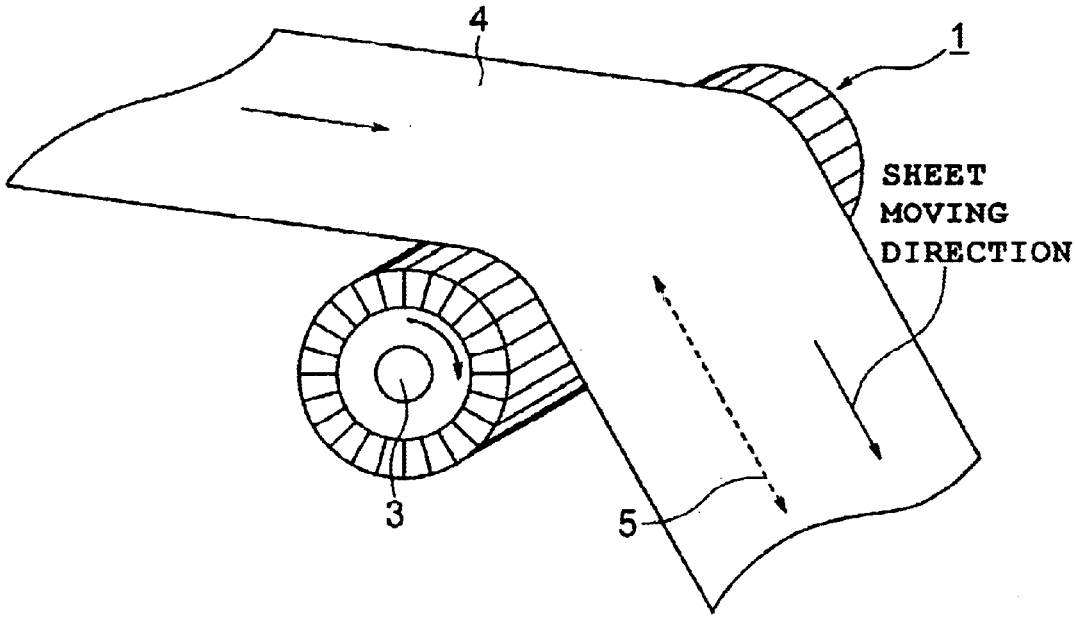
FIG. 9 is a perspective view of a method of magnetization of the present invention.

FIG. 9 shows the relationship of arrangement between the direction of travel and axis of easy magnetization of the magnetized sheet 4 and the cylindrical permanent magnet 1. As shown in FIG. 9, the sheet 4 travels in the sheet longitudinal direction, so the direction of travel of the sheet and the direction of the axis of easy magnetization 5 are the same. The cylindrical permanent magnet 1 is placed so that its shaft 3 is orthogonal to the sheet longitudinal direction.

Figure 10:
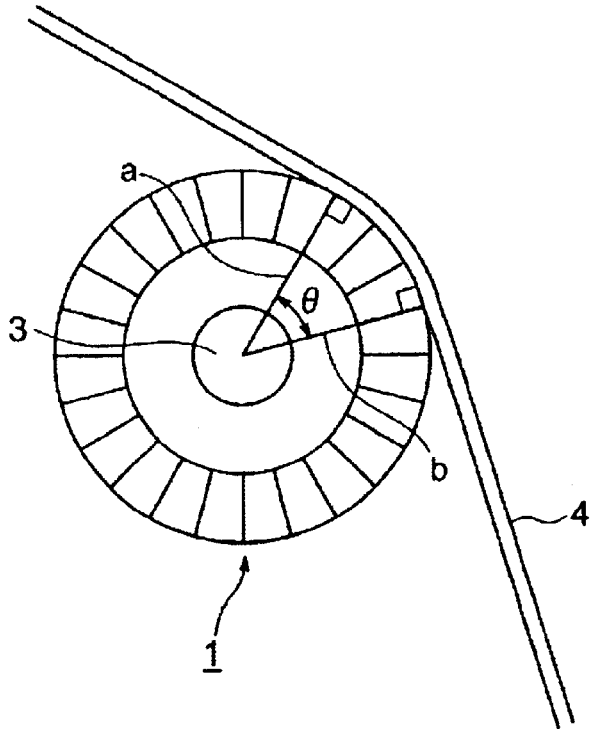
FIG. 10 is a view explaining an angle of contact of a cylindrical permanent magnet and a magnetic sticking sheet according to a method of magnetization of the present invention.

FIG. 10 shows the angle of contact of the cylindrical permanent magnet and the magnetic sticking sheet. As shown in FIG. 10, the angle of contact θ is the angle formed at the center of the shaft 3 between a normal line a of the surface of the sheet 4 fed to the cylindrical permanent magnet 1 and a normal line b of the surface of the sheet 4 leaving the cylindrical permanent magnet 1. In the sheet longitudinal direction, the normal lines a and b pass through the two ends of the part where the cylindrical permanent magnet 1 and the sheet 4 contact each other.

For continuously magnetizing the magnetic sticking sheet 4 by the cylindrical permanent magnet 1, it is necessary to make the angle of contact a suitable value. When the angle of contact is larger than a suitable range, the magnetic sheet sticks to the cylindrical permanent magnet by more than the angle of contact, the magnetic sheet flaps, and feed of the sheet is obstructed. Due to this, sometimes non-magnetized parts or parts with uneven magnetization pitch will occur.

As opposed to this, when the angle of contact is smaller than the suitable range, the area of contact between the cylindrical permanent magnet 1 and the sheet 4 becomes smaller. Since the sheet 4 travels due its being rolled up on the rolling reel 9 rotated by the motor, the sheet 4 does not stop traveling, but the cylindrical permanent magnet 1 rotates along with advance of the sheet 4.

Therefore, when the area of contact between the cylindrical permanent magnet 1 and the sheet 4 becomes too small, rotation of the cylindrical permanent magnet 1 can no longer keep up with the advance of the sheet 4. Since the N-poles and S-poles are arranged alternately on the circumference of the cylindrical permanent magnet 1, if the cylindrical permanent magnet 1 does not rotate following the advance of the sheet 4, the sheet 4 cannot be multipolar-magnetized. For the above reasons, in the method of magnetization of the embodiment of the present invention, it is preferable to make the angle of contact one within a predetermined range. The preferable range of the angle of contact can be said to be in the range of about 14 to 45° from the following examples.

Next, specific examples of the present invention will be explained. The present invention is not limited to these examples, however.

EXAMPLE 1

As shown in FIG. 4, a cylindrical rare earth permanent magnet having N-poles and S-poles arranged alternately on the circumference was prepared. Further, a magnetization apparatus including a cylindrical permanent magnet as shown in FIG. 8 was prepared. In this magnetization apparatus, the cylindrical permanent magnet and the magnetized sheet are arranged so that the shaft of the magnet is orthogonal to the axis of easy magnetization of the magnetized sheet and so that the magnetic layer of the magnetized sheet contacts the cylindrical permanent magnet (see FIG. 6). The magnetized sheet is magnetized by the cylindrical permanent magnet while being rolled up. The sheet is magnetized in a direction along the axis of easy magnetization.

The cylindrical permanent magnet was prepared to have an external shape of a diameter of 100 mm and a length of 1150 mm. The maximum value of the magnetic field in the tangential direction perpendicular to the axial direction of the cylindrical permanent magnet was 6000 Gauss. The cylindrical permanent magnet was held in a manner adjustable in angle of contact. The angle of contact was set to 14°.

The ingredients of Table 1 were mixed by a ball mill to disperse them homogeneously and prepare a magnetic coating material. A curing agent (Coronate HL, brand name of Nippon Polyurethane Industry Co., Ltd.) was added to this coating material in an amount of 0.3 part by weight. After this, the coating material was coated on the opposite surface of the printing surface of white synthetic paper including an ink jet printable layer by a knife coater.

Figure 11:
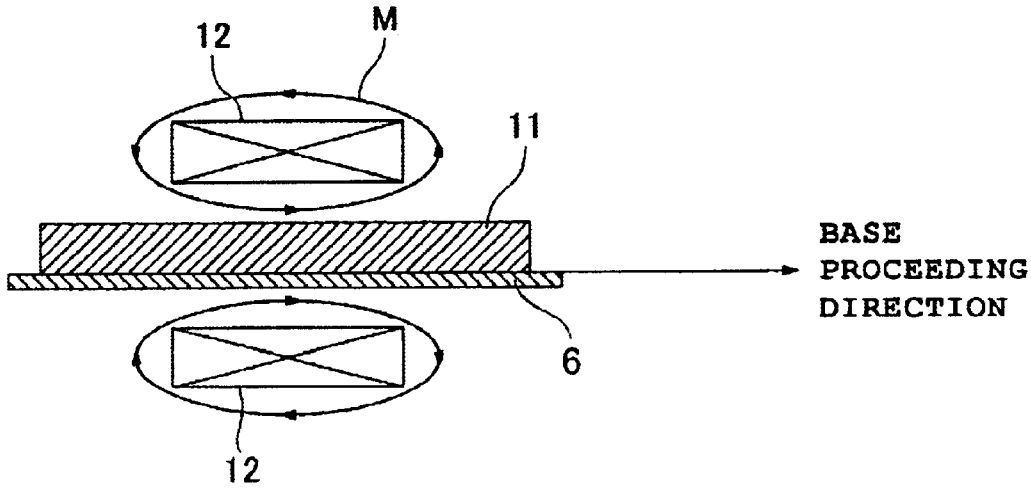
FIG. 11 is a schematic view of a method of orienting an axis of easy magnetization in a production step of a magnetic sticking sheet according to an embodiment of the present invention.

Next, the sheet was passed through an in-plane oriented magnetic field of 4000 Gauss formed by solenoid coils to orient it in-plane. FIG. 11 is a schematic view of orienting using solenoid coils. As shown in FIG. 11, an external magnetic field was applied to a magnetic coated film 11 on a non-magnetic base 6 from the solenoid coils 12. A pair of solenoid coils 12 generates a magnetic field having magnetic flux parallel to the direction of travel of the non-magnetic base 6 (magnetic lines of force M). When the magnetic coated film 11 passes between those solenoid coils 12, magnetic particles in the magnetic coated film become oriented in the sheet longitudinal direction in the plane of the sheet.

After in-plane orientation, the magnetic coated film was dried to form a magnetic layer. Due to this, a rolled sheet having a squareness ratio of 89% in the in-plane direction of the magnetic layer, a thickness of the magnetic layer of 0.05 mm, and a total thickness of 0.135 mm was obtained. The obtained rolled sheet was cured by keeping it in a 50° C. atmosphere for 20 hours or more to obtain the object for magnetization.

TABLE 1

| Ingredient | Type | Composition (parts by weight) |
|---|---|---|
| Magnetic particles | Sr ferrite<br>Average particle size: 1.2 $\mu$m<br>Saturation magnetization<br>$\sigma_s$ = 59 (emu /g)<br>Coercive force Hc = 2800 (Oe)<br>Shape: isotropic particles | 100 |
| Binder | Polyester polyurethane resin<br>Number average molecular weight Mn = 30000<br>Glass transition temperature Tg = 10 (° C.) | 12.5 |
| Solvent | Methyl ethyl ketone | 66 |

The object for magnetization was magnetized by the magnetization apparatus comprised as described above (see FIG. 8) so as to form a magnetic sticking sheet of Example 1. The magnetization pitch was set at 2.0 mm.

EXAMPLE 2

Except for using a magnetization apparatus as shown in FIG. 8 having a maximum value of the magnetic field of 8000 Gauss in the tangential direction perpendicular to the axial direction of the cylindrical permanent magnet 1, a magnetic sticking sheet was formed by the same procedure as in Example 1.

EXAMPLE 3

Except for changing the coercive force of magnetic particles of the above Table 1 to 3500 oersted (Oe), a magnetic sticking sheet was formed by the same procedure as in Example 1.

EXAMPLE 4

Except for changing the coercive force of magnetic particles of the above Table 1 to 3500 Oe, a magnetic sticking sheet was formed by the same procedure as in Example 2.

EXAMPLE 5

Except for changing the angle of contact to 40°, a magnetic sticking sheet was formed by the same procedure as in Example 1.

EXAMPLE 6

Except for changing the angle of contact to 45°, a magnetic sticking sheet was formed by the same procedure as in Example 1.

COMPARATIVE EXAMPLE

Except for changing the angle of contact to 50°, a magnetic sticking sheet was produced by the same procedure as in Example 1. At this time, the magnetic sheet stuck to the cylindrical permanent magnet at more than the angle of contact preset for the time of stopping and is fed while flapping. Due to this, the feed of the sheet was obstructed so magnetized parts and non-magnetized parts were formed and parts with uneven magnetization pitch were formed. That is, the magnetization did not go well.

The magnetic sticking sheets of all of the examples were evaluated for surface magnetic flux density and magnetic sticking force. The surface magnetic flux density was evaluated by using a Gauss meter (Model 4048, made by Bell) and a transverse type probe (T-4048-001) to measure the maximum magnetic flux density in the perpendicular direction to a surface of the magnetic layer at a distance of zero and averaging the measured values at any five points.

The magnetic sticking force was measured by cutting each magnetic sticking sheet to a 100 mm×100 mm size, adhering a resin sheet of the same shape as the cut sheet by an adhesive to the back surface of the magnetic sticking surface, sticking this magnetically to steel plate having a thickness of 0.5 mm fixed horizontally, and measuring the minimum peeling force by using a spring balance when peeling the sheet from the steel plate in a vertically upward direction. Here, the magnetic sticking force was derived from the equation {minimum peeling force−(sheet weight+adhesive weight+resin sheet weight)}/area of sheet.

The results of the evaluation are shown in Table 2.

TABLE 2

| | Maximum magnetic flux density between magnets (Gauss) | Maximum surface magnetic flux density of sheet (Gauss) | Angle of contact (°) | Magnetic sticking force (vs 0.5 mm thick steel plate): Sheet weight/ Magnetic sticking force | Magnetic sticking force (vs 0.5 mm thick steel plate): Measured value (gf/cm$^2$) |
|---|---|---|---|---|---|
| Example 1 | 6000 | 55 | 14 | 1/16 | 0.41 |
| Example 2 | 8000 | 65 | 14 | 1/19 | 0.49 |
| Example 3 | 6000 | 33 | 14 | 1/9 | 0.30 |
| Example 4 | 8000 | 60 | 14 | 1/17 | 0.44 |
| Example 5 | 6000 | 56 | 40 | 1/16 | 0.42 |
| Example 6 | 6000 | 55 | 45 | 1/16 | 0.41 |

The magnetic sticking sheets of Examples 1, 2, and 4 in particular exhibited a maximum magnetic flux density of two times or more the coercive force of the magnetic particles and, by being magnetized as described above, was able to exhibit a magnetic sticking force of more than 10 times their weight. Experience shows that magnet having a magnetic sticking force of three times or more its weight can be attached magnetically on a vertical surface in a still condition, but it is easily peeled off by external disturbance (external vibration, shock, wind pressure of indoor ventilation, etc.) The magnetic sticking sheets of Examples 1 and 2 have magnetic sticking forces of 10 times or more their weight, so sticks magnetically more stably even in an environment with external disturbance. In Examples 1 and 2, good magnetic sticking sheets can be obtained.

In Example 3, magnetic particles having a coercive force of 3500 Oe were used and the maximum magnetic flux density of the magnetization apparatus was 6000 Gauss, so the maximum magnetic flux density was less than two times the coercive force of the magnetic particles. Since the magnetic sticking sheet of Example 3 was magnetized in this manner, a lower magnetic sticking force than the other examples, nine times of its weight, was obtained.

It is also found from the results of Example 1 that a magnetic sticking sheet having a coercive force of magnetic particles of 3000 Oe or less can be sufficiently magnetized by a magnetization apparatus having a maximum magnetic flux density of 6000 Gauss. Further, as it is made clear from the results of Example 4, a magnetization apparatus having a maximum magnetic flux density of 8000 Gauss can magnetize a magnetic sticking sheet using ferromagnetic iron oxide having a higher coercive force.

It was found that the magnetic sticking sheets of Examples 5 and 6 gave characteristics equivalent to Example 1 and that an angle of contact of 40° and 45° was enough for magnetization without problems.

From the comparative example, it is found that the magnetic sheet sticks to the cylindrical permanent magnet at an angle of contact of 50° and therefore is fed while flapping, the sheet feed is disturbed, and the magnetization does not go well.

Note that even if making the angle of contact between 14° and 40°, when the coercive force of magnetic particles and the maximum magnetic flux density of the magnetization apparatus are similar to those of Examples 1, 5, and 6, magnetic sticking forces equivalent to those of the examples were obtained. In other words, in a range of the angle of contact of 14° to 45°, it is found that a certain magnetic sticking force can be obtained if the other conditions are the same.

When magnetizing a magnetic sticking sheet by magnetization coils, a complicated magnetization yoke, power supply unit, and drive power are required. As opposed to this, according to the method of magnetization and the magnetization apparatus of the present embodiment, the source of generating the magnetic field during magnetization used is, for example, the magnetic field formed by a rare earth permanent magnet. Therefore, it is not necessary to supply external energy especially for magnetization, so magnetization is possible semi-permanently. Due to this, the production cost of a magnetic sticking sheet can be reduced.

As clear from the above results, according to the method of magnetization using a cylindrical permanent magnet of the present embodiment, it becomes possible to magnetize a magnetic sticking sheet conveniently just by means of feeding the magnetic sticking sheet and rotating the cylindrical permanent magnet in the direction of axis of easy magnetization of the magnetic sticking sheet.

Further, the method of magnetization of the present embodiment is more advantageous than conventional methods of magnetization particularly when making the magnetization pitch narrower. When the magnetization pitch is made narrower, with magnetization coils, discharge occurs between electrodes. With the cylindrical permanent magnet as described in Japanese Unexamined Patent Publication (Kokai) No. 2001-230118, the leakage magnetic flux density decreases and sufficient magnetization becomes impossible. As opposed to this, with the cylindrical permanent magnet used for the magnetization apparatus of the present embodiment, even if the magnetization pitch is made narrower, the reduction of the leakage magnetic flux density is small. Therefore, strong magnetization is possible.

Further, compared with the capacitor type magnetization method of the prior art, the magnetization method of the present invention is less expensive, occupies less space, and is safer. A capacitor type magnetization apparatus requires a charging time, so continuous magnetization is difficult with a long magnetic sticking sheet in a rolled state. As opposed to this, in the method of the present invention, it is sufficient to make the cylindrical permanent magnet rotate and feed the magnetic sticking sheet. Continuous magnetization is therefore possible and the productivity is high. This is particularly effective when the sheet has a large width such as the A0 size and the magnetization apparatus becomes large.

According to the method of magnetization and magnetization apparatus of the embodiment of the present invention, it is possible to prevent a sheet from excessively sticking to the cylindrical permanent magnet during magnetization. Therefore, the sheet is fed to the cylindrical permanent magnet smoothly and it becomes possible to multipolar-magnetize a sheet uniformly at a high speed.

The method of magnetization and magnetization apparatus of the present invention are not limited to the above explanation. For example, the size of the cylindrical permanent magnet can be changed in accordance with the width of the roll-shaped magnetic sticking sheet. In addition, various modifications may be made within a range within the gist of the present invention.

Summarizing the effects of the present invention, according to the method of magnetization and magnetization apparatus of the present invention, it becomes possible to magnetize a roll sheet conveniently, at a high speed, and stably.

Note that the present invention is not limited to the above embodiments and includes modifications within the scope of the claims.

What is claimed is:

1. A method of magnetizing a magnetic sheet comprising the steps of:

bringing a cylindrical permanent magnet having a plurality of N-poles and S-poles alternately arranged along its circumference into contact with a surface of a magnetic sticking sheet having an axis of easy magnetization oriented in a sheet longitudinal direction wherein the permanent magnet is comprised of individual magnet portions having a line from an N-pole to an S-pole perpendicular to a core of the cylinder, the magnetic portions extending parallel to an axis of rotation, and rolling the magnetic sticking sheet in the sheet longitudinal direction to make the cylindrical permanent magnet contacting the magnetic sticking sheet rotate and multipolar-magnetize the magnetic sticking sheet along the axis of easy magnetization, wherein wherein an angle between a normal line to a surface of the magnetic sticking sheet at an initial point of contact with the cylindrical permanent magnet and a normal line to a surface of the magnetic sticking sheet at a final point of contact is 45° or less.

2. A method as set forth in claim 1, wherein, the cylindrical permanent magnet, comprised of a plurality of thin plate type magnets having one pole at the circumference side and the other pole at the shaft side arranged so that different pole surfaces face each other.

3. A magnetization apparatus for magnetizing a magnetic sheet comprising:

a cylindrical permanent magnet having a plurality of N-poles and S-poles located along its circumference wherein the permanent magnet is comprised of individual magnet portions having a line from an N-pole to an S-pole perpendicular to a core of the cylinder, the magnetic portions extending parallel to an axis of rotation and wherein the cylindrical permanent magnet is able to rotate around its shaft, a sheet feeding means for feeding a long magnetic sticking sheet having an axis of easy magnetization oriented in a sheet longitudinal direction to the cylindrical permanent magnet so that the magnetic sticking sheet and part of the circumference contact each other, a rolling means for rolling up the magnetic sticking sheet multipolar-magnetized by passing over the cylindrical permanent magnet, and a contact angle controlling means for adjusting an angle of duration of contact defined by an angle between a by a normal line to a surface of the magnetic sticking sheet at an initial contact point in the sheet longitudinal direction at a part where the cylindrical permanent magnet and the magnetic sticking sheet initially contact each other and a normal line to a surface of the magnetic sticking sheet at a final point of contact such that the angle is 45° or less.

4. A magnetization apparatus as set forth in claim 3, wherein the rolling means includes a driving means for driving said rolling means, and the cylindrical permanent magnet rotates due to the magnetic sticking sheet contacting the cylindrical permanent magnet being rolled up by said rolling means and is not driven when the magnetic sticking sheet does not move.

5. A magnetization apparatus as set forth in claim 3, wherein the cylindrical permanent magnet is a cylindrical combined permanent magnet comprised of a plurality of thin plate type permanent magnets having one pole at the circumference side and the other pole at the shaft side arranged so that different pole surfaces face each other.

* * * * *